US005101585A

United States Patent [19]

Gerbrandt

[11] Patent Number: 5,101,585

[45] Date of Patent: Apr. 7, 1992

[54] DIGGING IMPLEMENT

[75] Inventor: George Gerbrandt, Winnipeg, Canada

[73] Assignee: Met-Line Inc., Winnipeg, Canada

[21] Appl. No.: 673,456

[22] Filed: Mar. 22, 1991

[51] Int. Cl.[5] ..... E01H 5/09

[52] U.S. Cl. ..... 37/252; 37/258; 37/249

[58] Field of Search ..... 37/238, 242, 247, 249, 37/250, 251, 252, 254, 255, 257, 258, 285

[56] References Cited

U.S. PATENT DOCUMENTS

| | | | |
|---|---|---|---|
| Re. 19,754 | 11/1931 | Johnson | 37/256 |
| 2,320,723 | 6/1943 | Gaylord | 37/250 |
| 2,769,255 | 11/1956 | Mead | 37/257 |
| 3,043,028 | 7/1962 | Merry et al. | 37/250 |
| 3,239,954 | 3/1966 | Brier | 37/251 |
| 3,244,271 | 4/1966 | Wenning | 37/252 X |
| 3,349,506 | 10/1967 | Rubin | 37/248 |
| 3,913,247 | 10/1975 | Ruhl | 37/258 |
| 3,916,542 | 11/1975 | Blanchet | 37/256 |
| 4,100,687 | 7/1978 | Jeswise | 37/250 |
| 4,288,933 | 9/1981 | Fair | 37/259 |
| 4,385,457 | 5/1983 | Fralish | 37/250 |
| 4,457,086 | 7/1984 | Bacon | 37/257 |
| 4,765,073 | 8/1988 | Cloutier | 37/237 |
| 4,833,800 | 5/1989 | Ting | 37/243 |
| 4,852,279 | 8/1989 | Gerbrandt | 37/252 |

FOREIGN PATENT DOCUMENTS

| | | |
|---|---|---|
| 1032970 | 6/1978 | Canada . |
| 1075082 | 4/1980 | Canada . |

*Primary Examiner*—Randolph A. Reese
*Assistant Examiner*—Arlen L. Olsen
*Attorney, Agent, or Firm*—Murray E. Thrift; Stanley G. Ade; Adrian D. Battison

[57] ABSTRACT

A digging implement, for example, a snowthrower has a casing with a discharge from the casing and a coiled blade mounted in the casing on a lateral shaft. The blade is arranged for advancement sideways into a body of particulate material, e.g. snow. The blade shaft also carries a pair of discs attached to the shaft at opposite ends of the blade, with each of the discs having a cutting edge portion formed into radial corrugations. The discs cut kerfs in the snow at either end of the blade and reduce the power required to advance the implement into the material being removed.

5 Claims, 2 Drawing Sheets

DIGGING IMPLEMENT

FIELD OF THE INVENTION

The present invention relates to digging implements and more particularly to implements with driven, auger-type blades that advance sideways into the body of material being dug.

BACKGROUND OF THE INVENTION

The invention has particular application to snowthrowers and consequently will be described in the following with specific reference to that application, as set out in my prior U.S. Pat. No. 4,852,279. It is to be understood that other applications are intended to be included within the scope of this application.

In known snowthrowers, the blades are helical auger flights. In use, the blade is driven sideways against snow to be removed so that the blade scrapes off or cuts off snow and advances it towards a discharge, either at the end of the blade casing or in the centre, depending upon the blade configuration. At the discharge, an extruder throws the snow through a chute that is adjustable to control the distance and direction of throw. Throwers of any significant size are usually propelled by driven wheels or tracks. Similar characteristics are found in digging implements for earth and sand which employ similar auger arrangements.

A novel blade design for use in conventional snowthrowers was described in my U.S. Pat. No. 4,852,279. This patent describes a blade that is "aggressive" in that it draws itself and the snowthrower forward into the material being removed, so that powered propulsion could be reduced or eliminated in many cases, and replaced by skis or freely rotating wheels.

The present invention is described in relation to the exemplary embodiment set out in U.S. Pat. No. 4,852,279. However, it is to be understood that the improvements described herein may be applicable to other known snowthrowing devices.

SUMMARY OF THE INVENTION

According to one aspect of the present invention there is providing a digging implement of the type comprising a casing, a discharge from the casing, and a coiled blade arranged for advancement sideways into a body of particulate material, the improvement comprising a pair of discs attached to the blade at opposite ends thereof and each having an edge portion formed into corrugations.

The snowthrower may be a single stage type or two stage type, where a secondary extruder receives snow from the main blade and propels it through the snow discharge.

The discs cut kerfs in the particulate material to be handled. This reduces the power required to advance the implement, such as a snowblower, into the material.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the accompanying drawings which illustrate an exemplary embodiment of present invention.

In the drawings like characters of reference indicate corresponding parts in the different figures.

DETAILED DESCRIPTION

Figure 1:
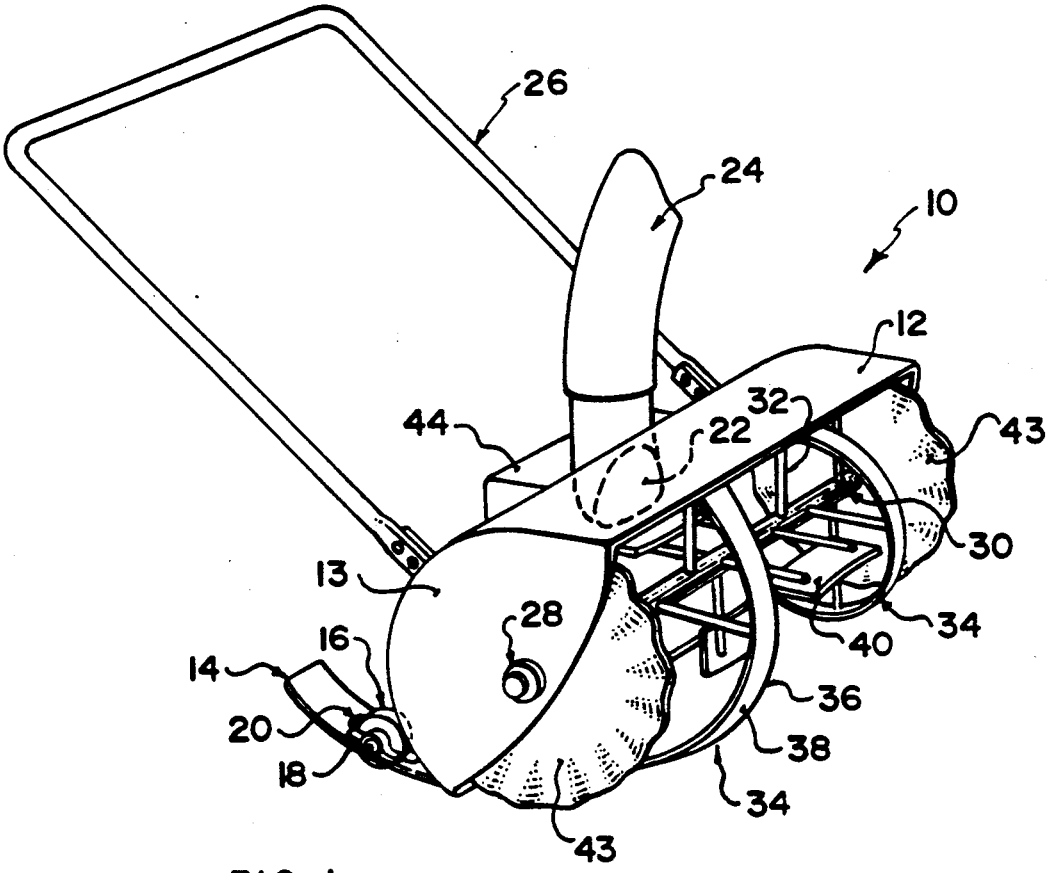
FIG. 1 is a perspective view illustrating a snowthrower incorporating an embodiment of this invention.
Figure 2:
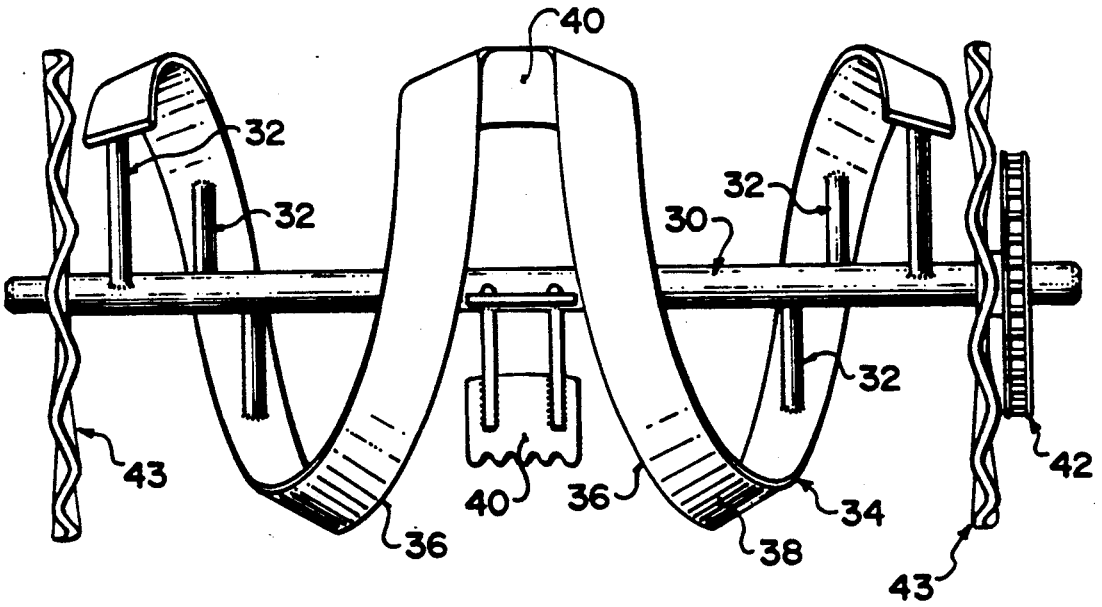
FIG. 2 is a front elevation of the digging blade components therein.
Figure 3:
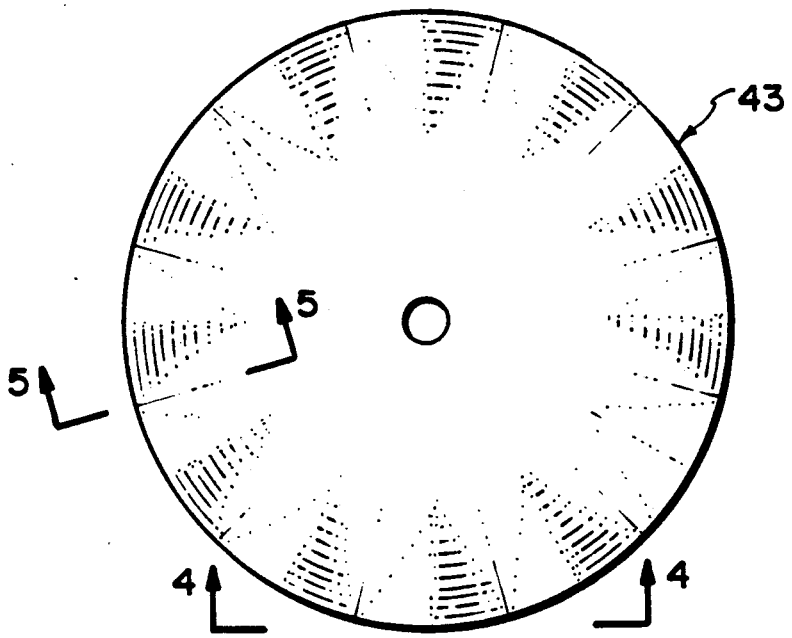
FIG. 3 is a side elevation of a corrugated disc.
Figure 4:
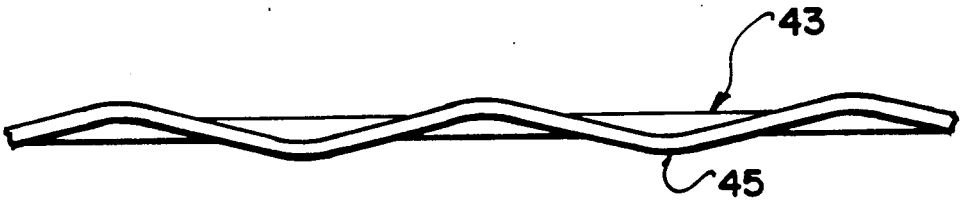
FIG. 4 is a cross section of the corrugated edge of the disc taken along the lines 4—4 of FIG. 3.
Figure 5:
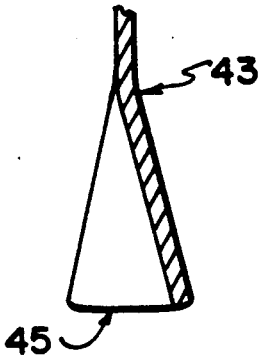
FIG. 5 is a view of a section of the edge of the disc shown in FIG. 3 taken along the lines 5—5 of FIG. 3.

The present invention is described in conjuction with the snowthrower described in my U.S. Pat. No. 4,852,729 and it is described herein as part of that snowthrower, but it is intended that the snowthrower is described herein for illustrative purposes only and not as limiting the scope of the present invention.

With reference to the drawings, the illustrated snowthrower 10 has a part cylindrical casing 12 with end walls 13. The casing is supported on a combination of skis 14 and wheels 16. The wheels 16 are mounted in bearings 18 on the skis and project slightly below the skis through slots 20 in the skis.

The casing has a discharge opening 22 at the centre between the end walls 13 and leading tangentially upwards into a chute 24 of a conventional type for discharging snow to one side or the other of the snowthrower, depending upon the setting of the chute. A handle 26 is mounted on the casing 12 to allow for manual propulsion and steering of the thrower.

The end walls 13 of the casing 12 are equipped with bearings 28 that support a shaft 30 extending along the axis of the casing 12. The shaft carries a series of spokes 32 that project radially from the shaft and support, at their outer ends, a snowthrower blade 34. The blade is double-ended. It consists of two steel bands on opposite sides of the discharge 22. Each is helically coiled to extend between the discharge and the adjacent end 13 of the casing 12. Each band has a helically coiled leading edge 36 and a tapered body 38 that slopes towards the shaft 30 in a direction away from the centre discharge 22. Between the blades 34 are four extruder blades or "paddles" 40 that project radially from the shaft 30 to drive snow in the centre of the casing 12 around the casing to throw it out of the discharge opening 22 and the chute 24. One of the paddles joins the inner ends of the two blades, and the others are arranged at 90° intervals around the axis. The blade is driven by a chain drive 42 from a motor 44 mounted on the casing 12 below the chute 24.

The shaft also carries a pair of corrugated discs 43, one on each end of the shaft, positioned outwardly from the blades 34, within the casing 12. The discs 43 project radially from the shaft 30, and have corrugated edges 45 therealong. The corrugations are radially oriented, with a short radial extent, for example ½ inch to 1½ inch as a typical range. The axial amplitude of the corrugations is typically ½ inch.

The discs 43 have a diameter approximately equal to the diameter of the thrower blade helix.

In operation, the snowthrower is advanced into a snow face. It may be driven by powered tracks or wheels. This may be augmented by the aggressive blade as described in the earlier patent. The rotating corrugated discs 43 positioned at each end of the shaft 30 within the casing 12, cut into the advancing snow. This action results in an increased penetration ability and a reduction in the snow resistance. The snow is directed into the blade path and the disc operation results in a clean "knife-like" cut in the snow, that leaves a distinct path through the snow.

The discs 43 are described in use with the aggressive blade that draws itself into the particular material as described in my U.S. Pat. No. 4,852,729, however it may be used on conventional snowthrowers of the single stage or two-stage type.

The foregoing description of the specific embodiments of the present invention is intended for illustrative purposes only and not as limiting the scope of the present invention.

The present invention is intended to be limited solely by the scope of the appended claims.

I claim:

1. In a digging implement of the type comprising a casing, a discharge from the casing, and a coiled blade mounted on a shaft within the casing arranged for advancement sideways into the body of particulate material, the improvement comprising a pair of discs attached to the shaft on which the blade is mounted at opposite ends of the blade and each of the discs having an edge portion formed into radial corrugations.

2. A snowthrower comprising a casing, a snow discharge from the casing, a coiled blade mounted on a shaft within the casing arranged for advancement sideways into a body of snow, and a pair of discs attached to the shaft on which the blade is mounted at opposite ends of the blade and each of the discs having an edge portion with radial corrugations.

3. The invention according to claim 1 or claim 2 in which each disc is a solid disc.

4. The invention according to claim 1 or claim 2 in which each disc has a diameter substantially equal to that of the blade.

5. The invention according to claim 1 or claim 2 in which the corrugations are radially oriented with a radial extent in the range from ½ inch to 1½ inch and an axial amplitude of ½ inch.

* * * * *